US008017850B2

(12) United States Patent
Kurebayashi

(10) Patent No.: US 8,017,850 B2
(45) Date of Patent: Sep. 13, 2011

(54) ELECTRONIC MUSICAL INSTRUMENT HAVING AD-LIB PERFORMANCE FUNCTION AND PROGRAM FOR AD-LIB PERFORMANCE FUNCTION

(75) Inventor: Kiyomi Kurebayashi, Hamamatsu (JP)

(73) Assignee: Kabushiki Kaisha Kawai Gakki Seisakusho, Shizuoka (JP)

( * ) Notice: Subject to any disclaimer, the term of this patent is extended or adjusted under 35 U.S.C. 154(b) by 144 days.

(21) Appl. No.: 12/555,671

(22) Filed: Sep. 8, 2009

(65) Prior Publication Data

US 2010/0224051 A1 Sep. 9, 2010

(30) Foreign Application Priority Data

Sep. 9, 2008 (JP) ..... 2008-230863
Aug. 3, 2009 (JP) ..... 2009-180699

(51) Int. Cl.
*G10H 3/00* (2006.01)

(52) U.S. Cl. ..... 84/609; 84/649

(58) Field of Classification Search ..... 84/609, 84/649

See application file for complete search history.

(56) References Cited

U.S. PATENT DOCUMENTS

| | | | | | |
|---|---|---|---|---|---|
| 4,682,526 | A | * | 7/1987 | Hall et al. | 84/613 |
| 5,200,566 | A | * | 4/1993 | Shimaya | 84/609 |
| 5,206,447 | A | * | 4/1993 | Yamaguchi et al. | 84/635 |
| 5,218,157 | A | * | 6/1993 | Akagawa et al. | 84/637 |
| 5,260,509 | A | * | 11/1993 | Shimada et al. | 84/622 |
| 5,262,583 | A | * | 11/1993 | Shimada | 84/609 |
| 5,262,584 | A | * | 11/1993 | Shimada | 84/609 |
| 5,283,388 | A | * | 2/1994 | Shimada | 84/609 |
| 5,286,912 | A | * | 2/1994 | Yamaguchi | 84/616 |
| 5,369,218 | A | * | 11/1994 | Konishi | 84/649 |
| 5,502,274 | A | * | 3/1996 | Hotz | 84/613 |
| 5,532,425 | A | * | 7/1996 | Nakata et al. | 84/609 |
| 5,859,382 | A | * | 1/1999 | Funaki | 84/637 |
| 2010/0224051 | A1 | * | 9/2010 | Kurebayashi | 84/637 |

FOREIGN PATENT DOCUMENTS

| | | | |
|---|---|---|---|
| JP | 2 151 897 | A | 6/1990 |
| JP | 5 035 273 | A | 2/1993 |

* cited by examiner

*Primary Examiner* — David S. Warren
(74) *Attorney, Agent, or Firm* — Christie, Parker & Hale, LLP

(57) ABSTRACT

The ROM 101 stores a chord scale note table composed of a plurality of scale by 12 notes starting from a chord tone in which C note is given as a root note and arranging a chord scale note as an inverted form of a chord in which the note is given as the lowest note. Where there is any change in chord at a beginning note of a phrase, or while phrase is played, notes are replaced to suppress note jump by using the chord scale note table. Where time from the previous key-on to the current key-on is in excess of a predetermined time, the note jump will not be suppressed.

10 Claims, 14 Drawing Sheets

Fig. 1
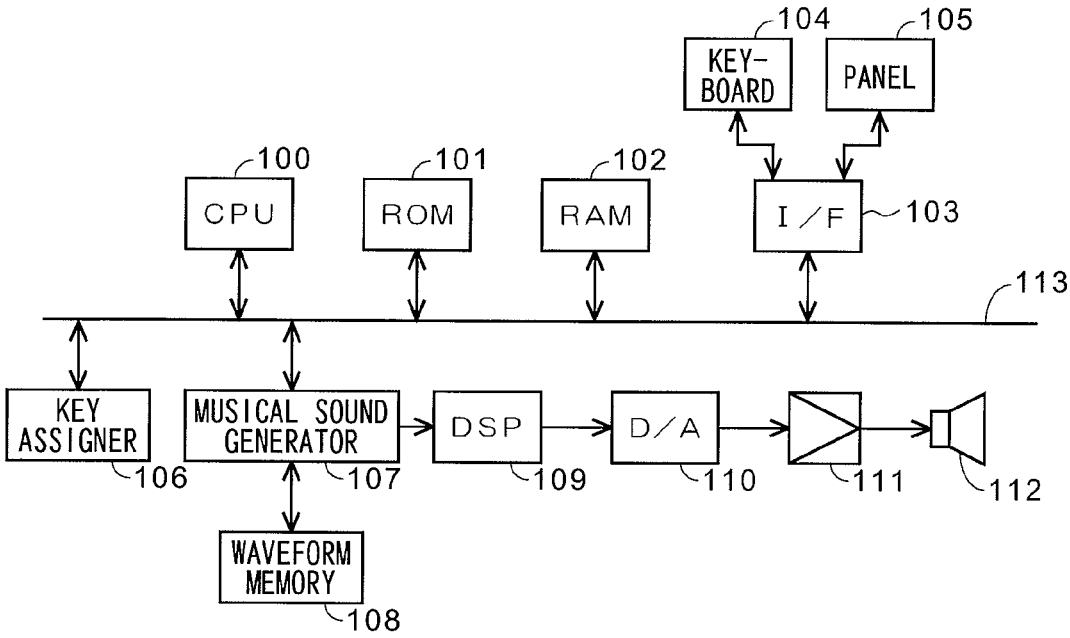
Fig. 2
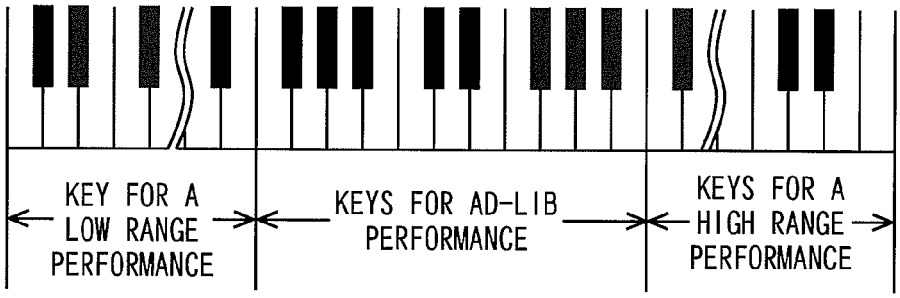
Fig. 3
| | |
|---|---|
| KEY (1) | PHRASE DATA (1) |
| KEY (2) | PHRASE DATA (2) |
| KEY (3) | PHRASE DATA (3) |
| KEY (4) | PHRASE DATA (4) |
| ⋮ | ⋮ |

Fig. 5

```
/*C   , C#  , D   , Eb  , E   , F   , F#  , G   , G#  , A   , Bb  , B   */
{ /* Major */
{ C_3 , Db3 , D_3 , Eb3 , E_3 , G_3 , Gb3 , G_3 , Ab3 , A_3 , B_3 , C_4 , },
{ E_3 , Gb3 , G_3 , Gb3 , G_3 , A_3 , B_3 , C_4 , Db4 , D_4 , Eb4 , E_4 , },
{ G_3 , Ab3 , A_3 , B_3 , C_4 , D_4 , Eb4 , E_4 , Gb4 , G_4 , Gb4 , G_4 , },
{ C_4 , Db4 , D_4 , Eb4 , E_4 , G_4 , Gb4 , G_4 , Ab4 , A_4 , B_4 , C_5 , },
{ E_4 , Gb4 , G_4 , Gb4 , G_4 , A_4 , B_4 , C_5 , Db5 , D_5 , Eb5 , E_5 , },
{ G_4 , Ab4 , A_4 , B_4 , C_5 , D_5 , Eb5 , E_5 , Gb5 , G_5 , Gb5 , G_5 , },
{ C_5 , Db5 , D_5 , Eb5 , E_5 , G_5 , Gb5 , G_5 , Ab5 , A_5 , B_5 , C_6 , },
{ E_5 , Gb5 , G_5 , Gb5 , G_5 , A_5 , B_5 , C_6 , Db6 , D_6 , Eb6 , E_6 , },},

{ /* m */
{ C_3 , Bb3 , C_3 , D_3 , Eb3 , F_3 , Gb3 , G_3 , A_3 , Bb3 , B_3 , C_4 , },
{ Eb3 , E_3 , F_3 , Gb3 , G_3 , Bb3 , B_3 , C_4 , D_4 , Eb4 , D_4 , Eb4 , },
{ G_3 , A_3 , Bb3 , B_3 , C_4 , C_4 , D_4 , Eb4 , E_4 , F_4 , Gb4 , G_4 , },
{ C_4 , B_3 , C_4 , D_4 , Eb4 , F_4 , Gb4 , G_4 , A_4 , Bb4 , B_4 , C_5 , },
{ Eb4 , E_4 , F_4 , Gb4 , G_4 , Bb4 , B_4 , C_5 , D_5 , Eb5 , D_5 , Eb5 , },
{ G_4 , A_4 , Bb4 , B_4 , C_5 , C_5 , D_5 , Eb5 , E_5 , F_5 , Gb5 , G_5 , },
{ C_5 , B_4 , C_5 , D_5 , Eb5 , F_5 , Gb5 , G_5 , A_5 , Bb5 , B_5 , C_6 , },
{ Eb5 , E_5 , F_5 , Gb5 , G_5 , Bb5 , B_5 , C_6 , D_6 , Eb6 , D_6 , Eb6 , },},

{ /* m7 */
{ G_3 , Gb3 , G_3 , A_3 , Bb3 , Bb3 , B_3 , C_4 , D_4 , Eb4 , D_4 , Eb4 , },
{ Bb3 , A_3 , Bb3 , B_3 , C_4 , Eb4 , D_4 , Eb4 , E_4 , F_4 , Gb4 , G_4 , },
{ C_4 , B_3 , C_4 , D_4 , Eb4 , F_4 , Gb4 , G_4 , G_4 , Bb4 , A_4 , Bb4 , },
{ Eb4 , E_4 , F_4 , Gb4 , G_4 , G_4 , A_4 , Bb4 , B_4 , C_5 , B_4 , C_5 , },
{ G_4 , Gb4 , G_4 , A_4 , Bb4 , Bb4 , B_4 , C_5 , D_5 , Eb5 , D_5 , Eb5 , },
{ Bb4 , A_4 , Bb4 , B_4 , C_5 , Eb5 , D_5 , Eb5 , E_5 , F_5 , Gb5 , G_5 , },
{ C_5 , B_4 , C_5 , D_5 , Eb5 , F_5 , Gb5 , G_5 , G_5 , Bb5 , A_5 , Bb5 , },
{ Eb5 , E_5 , F_5 , Gb5 , G_5 , G_5 , A_5 , Bb5 , B_5 , C_6 , B_5 , C_6 , },},

{ /*_7 */
{ G_3 , Gb3 , G_3 , A_3 , Bb3 , Bb3 , B_3 , C_4 , C_4 , E_4 , Eb4 , E_4 , },
{ Bb3 , A_3 , Bb3 , B_3 , C_4 , E_4 , Eb4 , E_4 , Gb4 , G_4 , Gb4 , G_4 , },
{ C_4 , B_3 , C_4 , Eb4 , E_4 , E_4 , Gb4 , G_4 , A_4 , Bb4 , A_4 , Bb4 , },
{ E_4 , Gb4 , G_4 , Gb4 , G_4 , G_4 , A_4 , Bb4 , B_4 , C_5 , B_4 , C_5 , },
{ G_4 , Gb4 , G_4 , A_4 , Bb4 , Bb4 , B_4 , C_5 , C_5 , E_5 , Eb5 , E_5 , },
{ Bb4 , A_4 , Bb4 , B_4 , C_5 , E_5 , Eb5 , E_5 , Gb5 , G_5 , Gb5 , G_5 , },
{ C_5 , B_4 , C_5 , Eb5 , E_5 , E_5 , Gb5 , G_5 , A_5 , Bb5 , A_5 , Bb5 , },
{ E_5 , Gb5 , G_5 , Gb5 , G_5 , G_5 , A_5 , Bb5 , B_5 , C_6 , B_5 , C_6 , },},

{ /* m7 b5 */
{ Gb3 , G_3 , Ab3 , A_3 , Bb3 , Bb3 , B_3 , C_4 , D_4 , Eb4 , D_4 , Eb4 , },
{ Bb3 , A_3 , Bb3 , B_3 , C_4 , C_4 , D_4 , Eb4 , F_4 , Gb4 , F_4 , Gb4 , },
{ C_4 , B_3 , C_4 , D_4 , Eb4 , F_4 , F_4 , Gb4 , G_4 , Ab4 , A_4 , Bb4 , },
{ Eb4 , D_4 , Eb4 , F_4 , Gb4 , Ab4 , A_4 , Bb4 , B_4 , C_5 , B_4 , C_5 , },
{ Gb4 , G_4 , Ab4 , A_4 , Bb4 , Bb4 , B_4 , C_5 , D_5 , Eb5 , D_5 , Eb5 , },
{ Bb4 , A_4 , Bb4 , B_4 , C_5 , C_5 , D_5 , Eb5 , F_5 , Gb5 , F_5 , Gb5 , },
{ C_5 , B_4 , C_5 , D_5 , Eb5 , F_5 , F_5 , Gb5 , G_5 , Ab5 , A_5 , Bb5 , },
{ Eb5 , D_5 , Eb5 , F_5 , Gb5 , Ab5 , A_5 , Bb5 , B_5 , C_6 , B_5 , C_6 , },},

{ /* dim */
{ Eb3 , D_3 , Eb3 , F_3 , Gb3 , Gb3 , Ab3 , A_3 , B_3 , C_4 , B_3 , C_4 , },
{ Gb3 , F_3 , Gb3 , Ab3 , A_3 , A_3 , B_3 , C_4 , D_4 , Eb4 , D_4 , Eb4 , },
{ A_3 , Ab3 , A_3 , B_3 , C_4 , C_4 , D_4 , Eb4 , F_4 , Gb4 , F_4 , Gb4 , },
{ C_4 , B_3 , C_4 , D_4 , Eb4 , Eb4 , F_4 , Gb4 , Ab4 , A_4 , Ab4 , A_4 , },
{ Eb4 , D_4 , Eb4 , F_4 , Gb4 , Gb4 , Ab4 , A_4 , B_4 , C_5 , B_4 , C_5 , },
{ Gb4 , F_4 , Gb4 , Ab4 , A_4 , A_4 , B_4 , C_5 , D_5 , Eb5 , D_5 , Eb5 , },
{ A_4 , Ab4 , A_4 , B_4 , C_5 , C_5 , D_5 , Eb5 , F_5 , Gb5 , F_5 , Gb5 , },
{ C_5 , B_4 , C_5 , D_5 , Eb5 , Eb4 , F_5 , Gb5 , Ab5 , A_5 , Ab5 , A_5 , },},
```

Fig. 17

(FOR SONG (GROUP) 1/TONE (GROU) 1/MODERATE/LOW TEMPO)

| | |
|---|---|
| KEY (1) | PHRASE DATA (1) |
| KEY (2) | PHRASE DATA (2) |
| KEY (3) | PHRASE DATA (3) |
| ⋮ | ⋮ |

(FOR SONG (GROUP) 1/TONE (GROU) 2/MODERATE/LOW TEMPO)

| | |
|---|---|
| KEY (1) | PHRASE DATA (1′) |
| KEY (2) | PHRASE DATA (2′) |
| KEY (3) | PHRASE DATA (3′) |
| ⋮ | ⋮ |

⋮

(FOR SONG (GROUP) 1/TONE (GROU) 1／HIGH TEMPO)

| | |
|---|---|
| KEY (1) | PHRASE DATA (1′′) |
| KEY (2) | PHRASE DATA (2′′) |
| KEY (3) | PHRASE DATA (3′′) |
| ⋮ | ⋮ |

(FOR SONG (GROUP) 1/TONE (GROU) 2／HIGH TEMPO)

| | |
|---|---|
| KEY (1) | PHRASE DATA (1′′) |
| KEY (2) | PHRASE DATA (2′′) |
| KEY (3) | PHRASE DATA (3′′) |
| ⋮ | ⋮ |

⋮

Fig. 18
```
/*  [C,C#, D,D#, E, F,F#, G,G#, A,A#, E*/
    {0, 1, 0, 0, 0, 0, 0, 0, 0, 0, 0, 0,},      /* Major */
    {0, 1, 0, 2, 1, 0, 1, 0, 1, 0, 0, 0,},      /* minor */
    {0, 1, 0,-1,-1, 0, 0, 0, 1, 1, 0,-1,},      /* min7 */
    {0, 1, 0, 0, 0, 0, 0, 0, 1, 0, 0,-1,},      /* 7th */
    {0, 0,-1,-1,-1, 0,-1,-1, 0,-1, 0,-1,},      /* m7( b 5) */
    {0, 1, 0,-1,-1, 0,-1,-1, 0, 0,-1, 0,},      /* dim */
```
Fig. 19
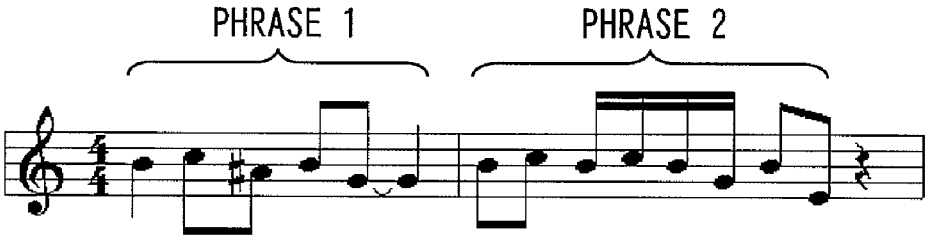
Fig. 20
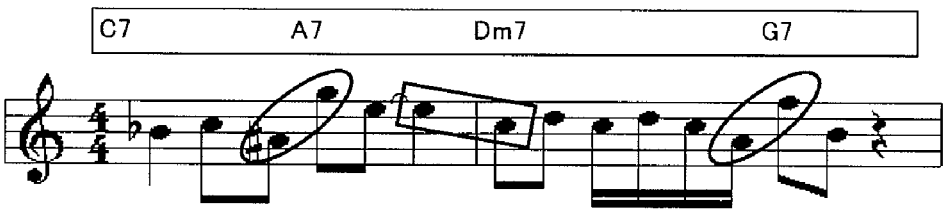

ELECTRONIC MUSICAL INSTRUMENT HAVING AD-LIB PERFORMANCE FUNCTION AND PROGRAM FOR AD-LIB PERFORMANCE FUNCTION

CROSS-REFERENCE TO RELATED APPLICATION(S)

This application claims priority to and the benefit of Japanese Patent Application No. 2008-230863, filed in the Japanese Patent Office on Sep. 9, 2008, and Japanese Patent Application No. 2009-180699, filed in the Japanese Patent Office on Aug. 3, 2009, the entire contents of which are incorporated herein by reference.

TECHNICAL FIELD

The present invention relates to an electronic musical instrument having ad-lib performance function and a program for ad-lib performance function, and in particular, to an electronic musical instrument having ad-lib performance function and a program for ad-lib performance function by which ad-lib performance can be performed by depressing each of keys in a specific range on a keyboard.

BACKGROUND ART

There are electronic musical instruments having automatic accompaniment function or automatic performance function and also having ad-lib performance function. The ad-lib performance function can be realized by procedures in which phrase data of a few bars is in advance assigned to each of keys in a specific range on a keyboard and built therein, and upon depressing each of keys in the specific range, phrase data assigned to the key concerned is read out from the beginning and allowed for note production only while depressing thereof.

The phrase data is built in as data of basic phrases according to C chord scale. In the automatic accompaniment function, when a chord by keyboard operation is detected, and in the automatic performance function, when a chord is detected in chord progression data inside song data, each of notes of a basic phrase are converted to notes on a chord scale note table corresponding to a detected chord and allowed for note production. The chord scale note table is constituted as a 12-scale note table starting from C root note according to each of chord types. Each of notes of the basic phrase is converted by adding a value according to root note of the detected chord.

Patent Literature 1 has described an electronic musical instrument having ad-lib performance function in which information on music sound waveforms of small-unit melody corresponding to each of keys in a specific range on a keyboard assigned for ad-lib performance is stored in advance, and, upon depressing each of keys in the specific range, music sound waveforms assigned to the key are read out to repeatedly reproduce musical sounds.

Patent Literature 2 has described an automatic accompaniment device in which an inverted form which can be naturally chained to a chord currently in note production is automatically selected, and note data is amended according to the inverted form, by which an interval will not jump before or after a change in chord in association with chord progression.

CITATION LIST

Patent Literature

Patent Literature 1: Japanese Published Unexamined Patent Application No. Hei 2-151897

Patent Literature 2: Japanese Published Unexamined Patent Application No. Hei 5-35273

SUMMARY OF INVENTION

Technical Problem

Basic phrases for ad-lib performance functions are expressed various ranges by upper interval phrases from interval phrases, or combination of them. A user is able to depress each of keys in a specific range on a keyboard, read out phrase data assigned to the key and produce notes. Therefore, the order by which the phrase data is read out, that is, the order of note production is to be different depending on the order by which the user depresses keys. Further, the user will not necessarily depress a key till producing the last note in a phrase or may depress a key covering one beat or one bar depending on the case. It is, therefore, impossible to estimate in which range the note production is ended.

For this reason, depending on the order by which a user depressed keys, notes will jump greatly and a song as a whole of a plurality of phrases may not be heard stably. For example, in a case where a phrase in a low range is allowed for note production and thereafter a phrase in a high range is selected, the phrase in the high range is unnaturally chained to the phrase in the low range with regard to an interval, and musical sounds as a whole of these two phrases may not be heard stably.

Further, where a user continues to depress a key in a specific range and, while a certain phrase is in the process of note production, a change is caused in a chord different in root note by automatic accompaniment or automatic performance. In this instance, the phrase is converted in midstream by a chord scale note table. A conventional chord scale note table is constituted only with scale by 12 notes starting from C root note according to each of the chord types. Therefore, the phrase is converted in midstream by adding only a value according to a route note with the chord scale note table, and the phrase may not be heard stably due to the fact that note will jump greatly in midstream of the phrase in case of some of the root notes at the time of a change in chord.

FIG. 18 is a drawing showing a conventional chord scale note table. Here, (/*[C, C♯, D, . . . , B]*/) indicates 12-scale information in which octave information is excluded from each of notes contained in phrase data, and columns corresponding to each of notes of the 12-scale information indicate an addition value for conversion according to each of the chord types. For example, where a chord type of chord is Major, C♯ note of phrase data is added by "1" and converted to D note.

FIG. 19 a drawing showing a example of a musical note based on phrase data. This example shows a musical note of two bars made up of phrases 1, 2 of one bar. The phrase data is, as described above, provided as data of basic phrase according to C chord scale. The phrases 1, 2 are assigned to each of keys in a specific range on a keyboard. When a key to which the phrase 1 on 2 is assigned is depressed, a corresponding phrase is read out from the beginning, and only when the key is depressed, notes are produced. In order to produce notes as shown in FIG. 19, a key to which the phrase 1 is assigned may be depressed during one bar and a key to which the phrase 2 is assigned may be then depressed during one bar.

FIG. 20 is a drawing showing a musical note in a case where the phrases 1, 2 of FIG. 16 are converted according to the chord scale note table of FIG. 15. In this instance, a case where chords are changed by every two beats according to C7, A7, Dm7 and G7 is illustrated.

For example, a first note of the phrase 1, "Ti" (key number 71) is converted to "Ti ♭" (key number 70) according to a change in chord to C7. A third note of the phrase 1, "La♯" (key number 70) is not changed. A fourth note of the phrase 1, "Ti" (key number 71) is converted to "So" (key number 79) in association with a change in chord to A7 at a third beat of the phrase 1. A final note of the phrase 1, (a sixth note), "Ti" (key number 67) is converted to "Mi" (key number 76). Further, a beginning note (a first note) of the phrase 2, "So" (key number 71) is converted to "Do" (key number 72) in association with a change in chord to Dm7. A sixth note, "So" (key number 67) is converted to "La" (key number 69). Still further, a seventh note, "Ti" (key number 71) is converted to "Fa" (key number 77) in association with a change in chord to G7.

In the above example, in a musical note of the phrases 1, 2, during the note production of one phrase (between the third note and the fourth note of the phrase 1 and between the sixth note and the seventh note of the phrase 2), a chord having a different chord root is detected. And when compared with original phrases 1, 2, note jump is found only by adding a value according to the root note (a part enclosed with the round frame). Further, between a final note of the phrase 1 (Mi) and a beginning note of the phrase 2 (Do), a three-degree gap of an interval (a part enclosed with the square frame) is found. Depending on the case of chord progression or ranges and form of each of phrases, the interval may be greater.

Patent Literature 1 has described an electronic musical instrument having ad-lib performance functions. However, it does not describe a problem to be solved for the above-described ad-lib performance or the solution thereof. Further, Patent Literature 2 has described automatic accompaniment for suppressing jumping of intervals before or after the change in chord in association with chord progression but does not describe a problem to be solved for the above-described ad-lib performance or the solution thereof.

An object of the present invention is to provide an electronic musical instrument having ad-lib performance function and a program for ad-lib performance function capable of suppressing note jump between phrases and at the time of a change in chord, when each of keys in a specific range on a keyboard is depressed to perform ad-lib performance.

In order to accomplish the object a first feature of this invention is an electronic musical instrument having ad-lib performance function in which phrase data of a few bars assigned to each of keys in a specific range on a keyboard is stored, while each of keys is depressed, phrase data assigned to the key is read out to produce notes, comprises a chord scale note table composed of a plurality of scale by 12 notes starting from a chord tone in which C note is given as a root note and arranging a chord scale note as an inverted form of a chord in which the note concerned is given as the lowest note; and a control unit for suppressing note jump by changing key number of the phrase data by using the chord scale note table.

A second feature of this invention is that, in the case of a beginning note of a phrase, the control unit selects such scale by 12 notes that an interval between a key number of a final note of the previous phrase and a key number of a converted note of the beginning note is made minimum from a plurality of scale by 12 notes in the chord scale note table corresponding to a chord type at the time, and the key number of the beginning note is replaced by a corresponding converted note among constituting notes of the scale by 12 notes.

A third feature of this invention is that, where the selected scale by 12 notes give a maximum value and reach a higher range than an expected range, the control unit selects again such scale by 12 notes that an interval between a reference key number and a key number of a converted note corresponding to a beginning note is made minimum from a plurality of scale by 12 notes in the chord scale note table corresponding to a chord type at the time, thereby the key number of the beginning note is replaced by a corresponding converted note among constituting notes of the scale by 12 notes.

A forth feature of this invention is that, among constituting notes of scale by 12 notes obtained by selecting, where there is any change in chord during note production of a phrase and in the case of a beginning note of the phrase, such scale by 12 notes that an interval between a key number of a final note of the previous phrase and a key number of a converted note corresponding to the beginning note is made minimum from a plurality of scale by 12 notes in the chord scale note table corresponding to a chord type at the time and by selecting again, where the thus selected scale by 12 notes give a maximum value and reach a higher range than an expected range, such scale by 12 notes that an interval between a reference key number and a key number of a converted note corresponding to the beginning note is made minimum from a plurality of scale by 12 notes in the chord scale note table corresponding to a chord type at the time, the control unit selects such scale by 12 notes that an interval between a key number of a converted note of a predetermined note arranged as a chord tone and a key number of a converted note corresponding to the predetermined note is made minimum from a plurality of scale by 12 notes in the chord scale note table corresponding to a chord type after a change in chord, thereby the key number of a note after a change in chord is replaced by a corresponding converted note of constituting notes in the scale by 12 notes.

A fifth feature of this invention is that, where time from the previous key-off to the current key-on is in excess of a predetermined time, the control unit does not suppress note jump between a final note of the previous phrase and a beginning note of the current phrase but allows the current phrase to produce notes in a predetermined range.

The present invention can be realized not only as an electronic musical instrument having ad-lib performance function but also as a program for ad-lib performance function. The program is loaded into an electronic musical instrument, by which it is possible to obtain an electronic musical instrument having ad-lib performance function.

Advantageous Effects of Invention

According to the present invention, where each of keys in a specific range on a keyboard to which phrase data of a few bars is assigned is depressed to perform ad-lib performance, an interval at the beginning of the current phrase is to be chained to an interval at the end of the previous phrase. It is, thereby, possible to suppress note jump between phrases. Further, where any change is made in chord during note production of a phrase, it is possible to suppress note jump resulting from the change thereof. Thereby, it is possible to produce musical sounds which are musically natural and can be heard stably.

Where time from the previous key-off to the current key-on is in excess of a predetermined time, note jump between phrases or at the time of a change in chord is not suppressed to provide performance closer to live performance, which may be preferable. This can be accomplished by procedures in which where time from the previous key-on to the current key-on is in excess of a predetermined time, note jump between a final note of the previous phrase and a beginning note of the current phrase is not suppressed but the current phrase is allowed for note production in a predetermined range.

BRIEF DESCRIPTION OF DRAWINGS

FIG. 1 is a functional block diagram showing a first embodiment of an electronic musical instrument in the present invention.

FIG. 2 is a drawing showing one example of a functional correspondence relationship between ranges on a keyboard and keys of each range.

FIG. 3 is a drawing showing an example of phrase data stored in the ROM 101.

FIG. 5 is a drawing showing a example of the chord scale note table used in the phrase note conversion process routine.

FIG. 17 is a drawing showing examples of plural sets of phrase data.

FIG. 18 is a drawing showing a conventional chord scale note table.

FIG. 19 a drawing showing an example of a musical note based on phrase data.

FIG. 20 is a drawing showing a musical note in a case where the phrases 1, 2 of FIG. 16 are converted according to the chord scale note table of FIG. 15.

DESCRIPTION OF EMBODIMENTS

Figure 4:
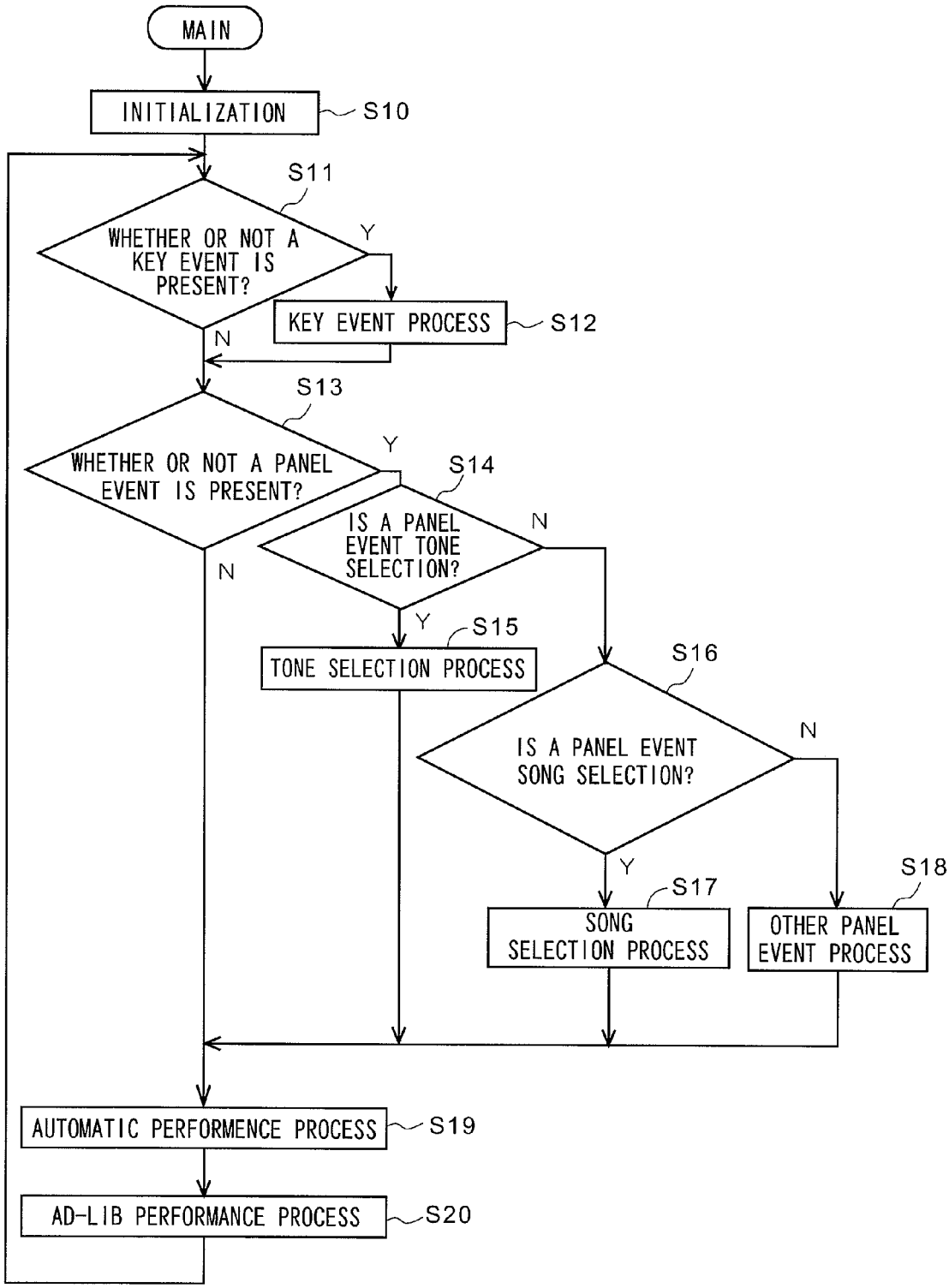
FIG. 4 is a main flowchart showing operation in the first embodiment.

Hereinafter, by referring to drawings, a description will be given for the present invention. In addition, in the following, the present invention will be described for a case where it is realized as an electronic musical instrument. However, the present invention can be realized as a program having ad-lib performance function which is loaded into an electronic musical instrument.

FIG. 1 is a functional block diagram showing a first embodiment of an electronic musical instrument in the present invention. In FIG. 1, a CPU 100 controls an electronic musical instrument in its entirety according to control programs stored in a ROM 101. The CPU 100 also acts as a control unit on ad-lib performance. The CPU 100 includes a timer interrupt circuit.

The ROM 101 stores programs for executing the control of an electronic musical instrument in its entirety, constant numbers, song data and others. The song data includes not only data on drum, bass and accompaniment parts but also data on chord progression necessary for ad-lib performance function. Further, a part of domain of the ROM 101 stores phrase data of a few bars assigned to each of keys in a specific range on a keyboard 104 for ad-lib performance (hereinafter, simply referred to as phrase data) so as to correspond to the key number of each of keys. The phrase data may be stored in a memory for phrase data (ROM) separate from the ROM 101.

A RAM 102 is used as a work area and a buffer of the CPU 100 and also stores various types of control data inside a musical instrument and MIDI data. The RAM 102 may be backed up, for example, by using a battery.

An I/F 103 is an interface for connecting the CPU 100 with the keyboard 104 and a panel 105 via a bus 113. The keyboard 104 includes a plurality of keys, a keyboard switch and its scan circuit. In addition, the keyboard 104 may have a plurality of keyboards such as an upper keyboard and a lower keyboard.

The panel 105 includes an operating device (buttons) for setting various conditions of an electronic musical instrument, a display device (LCD) and its access circuit. The operating device of the panel 105 includes a tone selecting button, a song selecting button in case of automatic performance function, a song performance/stop button, a mode selecting button for selecting a performance mode (normal, automatic, drum, bass modes), a tempo selecting button, and an ad-lib performance selecting button.

The ad-lib performance selecting button is an operating device for setting an ad-lib performance mode, by which, upon setting of the ad-lib performance mode, while each of keys in a specific range on a keyboard to which phrase data of a few bars is assigned is depressed, phrase data corresponding to the thus depressed key is read out at a tempo selected by the tempo selecting button to produce musical sounds. Function assigned to each of keys is managed by a key assigner 106.

A musical sound generator 107 reads out sequentially waveform data in an address interval proportional to a pitch for note production from a waveform memory 108 in which digital musical sound waveform sample values are stored, thereby making interpolation calculation to generate musical sound signal.

A DSP (digital signal processor) 109 provides various effects to musical sound signal output from the musical sound generator 107. The DSP 109 includes a D-RAM.

A digital musical sound signal generated from the DSP 109 is converted to an analog musical sound signal by a DA converter 110 and, thereafter, supplied via an amplifier 111 to a speaker 112. A bus 113 is to connect above-described components of an electronic musical sound generator. Musical sound information and control information are exchanged among individual components via the bus 113.

FIG. 2 is a drawing showing one example of a functional correspondence relationship between ranges on a keyboard and keys in each range. In this example, the keyboard is divided into three ranges, in which keys in a central range are allowed to function as keys for ad-lib performance, keys of an upper range are allowed to function as keys for a high range performance, and keys of a lower range are allowed to function as keys for a low range performance. These functions are obtained in a case where an ad-lib performance mode is set by an ad-lib performance selecting button on the panel 105.

FIG. 3 is a drawing showing an example of phrase data stored in the ROM 101. This phrase data is made up of phrase data (1), (2), . . . of a few bars which are stored so as to correspond to each of keys in the central range, and when each of keys in the central range are depressed, phrase data assigned the key is read out only during the depressing thereof. The phrase data is read out only once and not repeated. Therefore, even when the key for ad-lib performance is continuously depressed, note production is ended at time which corresponds to only one-time phrase data, and thereafter, only an undersong by automatic performance function is played in the background. Thereby, it is possible to make a rest bar intentionally. Further, a certain key is depressed only by one beat, by which, from the beginning, only a phrase covering one beat is read out to produce a note. Therefore, the key is depressed by one beat each, thus making it possible to give an intentional performance which is different in mood from one-bar phrase. As described above, a user is allowed to depress each of keys for ad-lib performance at any beat.

FIG. 4 is a main flowchart showing operation in the first embodiment. Hereinafter, for the sake of simplification, a description will be given for operation with automatic performance function and ad-lib performance functions. The operation with automatic accompaniment function and ad-lib performance function will be also described similarly.

When an electronic musical instrument is powered on, first, the instrument is in its entirety subjected to initialization (S10). This initialization includes the initialization of setting tone and music. Then, a determination is made for whether or not a key event is present (S11). When the key event is determined to be present, a key event process is executed (S12). The key event process includes a key-on event process on depressing a key and a key-off event process on release of a key.

After the key event process is executed in S12 or where the key event is determined to be absent at S11, a determination is made for whether or not a panel event is present (S13). Where the panel event is determined to be present, a panel event process is executed. The panel event process also includes a panel-on event process on turning on a button and a panel-off event process on turning off a button. Further, the panel event process includes a tone selection process (S15) by selecting tone (S14), a song selection process (S17) by selecting a song (S16) and a panel event process (S18) by others. After the panel key event process is executed in S14 or where the panel key event is determined to be absent in S13, an automatic performance process (S19) and an ad-lib performance process (S20) are executed and the processes return to (S15), S11.

Automatic performance is carried out where a mode selecting button on the panel 105 is used to select an automatic performance mode and a song selecting button is used to select a song. More specifically, the song selecting button is operated to select song data stored in the ROM 101, and a song performing button is operated to read out sequentially the song data from the beginning at a tempo selected by a tempo selecting button, thereby providing the automatic performance.

Further, where an ad-lib performance selecting button on the panel 105 is used to set an ad-lib performance mode, a key for ad-lib performance is depressed to instruct the start of ad-lib performance function in the key-on event process. In the ad-lib performance process (S20), phrase data assigned to depressed key is read out at a tempo selected by the tempo selecting button, thereby producing notes. Further, when the key for ad-lib performance is released, in the ad-lib performance process (S20), reading-out of the phrase data is stopped. More specifically, where the key for ad-lib performance is depressed, phrase data corresponding to the key concerned is read out from the ROM 101, thereby providing an ad-lib performance in the background of a music composition resulting from automatic performance function.

The ad-lib performance process (S20) includes a phrase note conversion process routine. The phrase note conversion process routine uses a chord scale note table, thereby converting the key number of note data to a scale note of the detected chord. The chord scale note table starts from a chord tone in which a root note is given as C note and is constituted with a plurality of scale by 12 notes in which chord scale notes are arranged as an inverted form of a chord in which the note is given as the lowest note. The chord scale note table is used, by which an interval at the beginning of the current phrase is to be chained to an interval at the end of the previous phrase.

As described so far, on an ordinary performance, according to the key number of note data generated by depression of keys, musical sounds are produced. On an automatic performance, according to built-in song data, musical sounds are produced automatically. Further, on ad-lib performance, according to phrase data converted by a phrase note conversion process routine, musical sounds are produced.

FIG. 5 is a drawing showing a example of the chord scale note table used in the phrase note conversion process routine. The chord scale note table is divided according to each of the chord types in which C note is given as chord root. For example, for each chord type of /*Major*/,/*m*/, /*m7*/, . . . , the chord scale note table is prepared.

For example, chord tones of Cm7 chord are C, E♭, G and B♭. On the chord scale note table, these constituting notes are arrayed at the left-most column as an actual note G__3 (key number 55), B♭3 (58), C__4 (60), . . . to start from each of note of C, E♭, G and B♭, and chord tones of B♭, C, E♭ and G are arranged as highest notes. In a basic form, the chord tones of C, E♭, G and B♭ are arrayed from below to give C, E♭, G and B♭, while in an inverted form, they are arrayed to give (E♭, G, B♭ and C), (G, B♭, C and E♭), (B♭, C, E♭ and G).

Chord scale notes include, in addition to chord tones, additive notes (quasi-chord tones) according to the chord tones and chord constituting non-chord tones. For example, in the case of Cm7 chord, the chord tones are C, E♭, G and B♭ but also include A as a quasi-chord tone and include D and F as chord constituting non-chord tones. The quasi-constituting notes and chord constituting non-chord tones vary depending on the situation of chord progression.

The chord scale note table is prepared to give scale by 12 notes including notes other than chord scale notes. Notes other than a chord scale note are mainly notes lower by half tone than the chord scale note. These notes lower by half tone are ornaments for individual chord scale notes.

In the chord scale note table of FIG. 5, scale by 12 notes are filled in the order of chord tones, quasi-chord tones and chord constituting non-chord tones. Then, remaining scales are filled with chord scale non-chord tones so that the scale can be chained smoothly, with notes on both sides taken into account. In this instance, (/*[C, C♯, D, . . . , B]*/) indicates 12 scale information in which octave information is excluded from each of notes contained in phrase data, and columns with respect to each of notes of the 12 scale information indicate converted notes according to each of the chord types. This figure shows that, for example, where a chord type is Major, C note of the phrase data is converted to any one of C3, E3, G3, . . . , and E5. This chord scale note table is given as one example, to which the present invention shall not be limited.

The chord scale note table used in the present invention is, as described above, provided with eight chord scale note arrays according to each of the chord types, which is different from a conventional chord scale note table made up of a single 12-scale array which starts from C root note according to each of the chord types.

Figure 6:
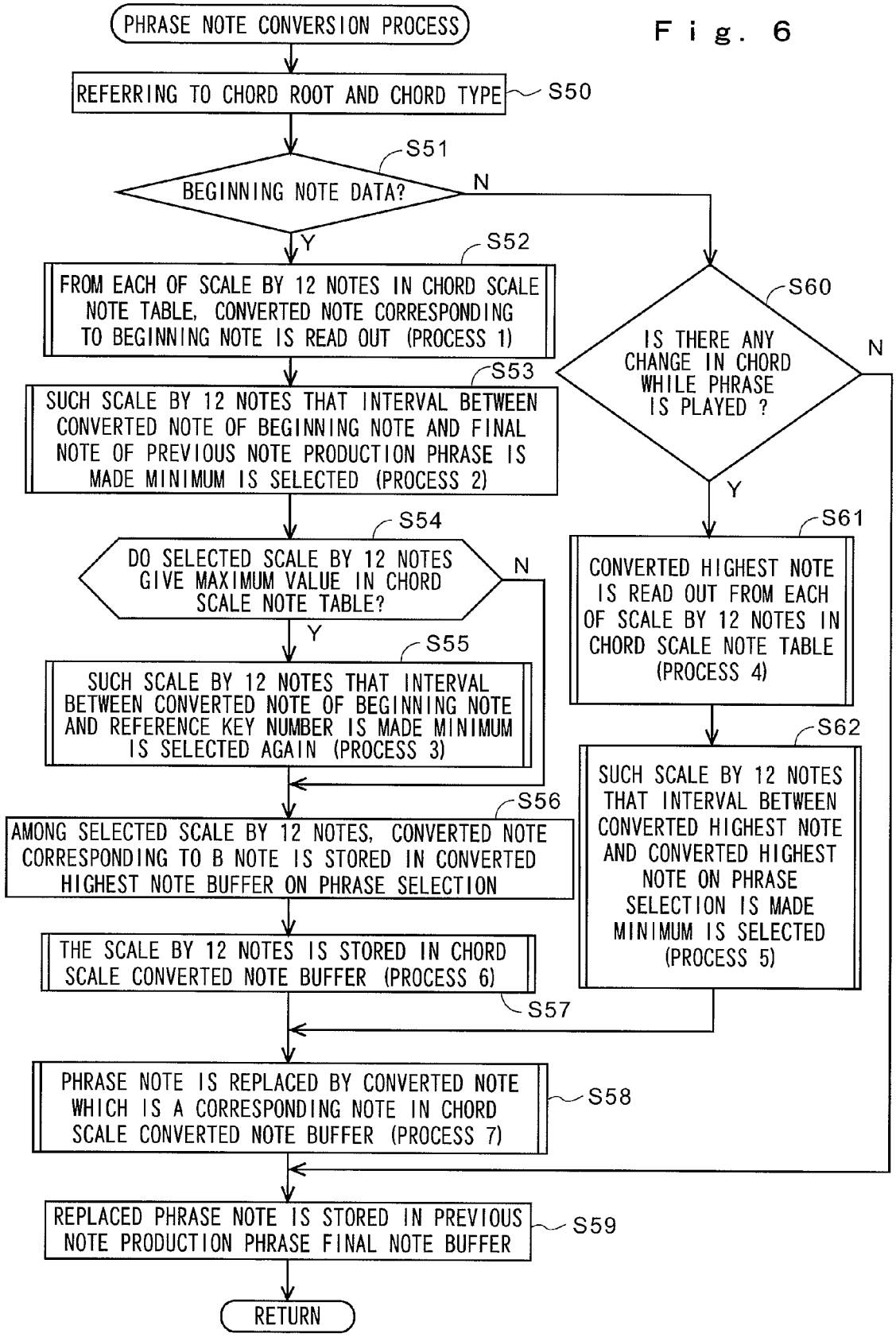
FIG. 6 is a flowchart showing a phrase note conversion process routine of the first embodiment.

FIG. 6 is a flowchart showing a phrase note conversion process routine of the first embodiment. Hereinafter, with reference to FIG. 6, a description will be given for motions of ad-lib performance function. First, as song data in automatic performance function, data covering accompaniment parts and chord progression parts corresponding thereto is stored in the ROM 101. Data of the accompaniment parts includes note data, while data of the chord progression parts includes chord data. Further, a plurality of phrase data are in advance stored in the ROM 101. The phrase data is basic phrase data according to C chord scale.

On an automatic performance, song data is read out sequentially at set tempo from the ROM 101 to produce musical sounds according to the song data. More specifically, note data of the accompaniment parts is read out at set tempo sequentially from the ROM 101 and sent to a routine of automatic performance process (S19). The automatic performance process (S19) generates musical sound signals according to the note data to output the musical sounds. In a similar manner, chord data of the chord progression parts is read out from the ROM 101 and stored and retained in the RAM 102 as chord root data and chord type data.

In the phrase note conversion process routine (FIG. 6), by referring to a chord root and a chord type stored in the RAM 102 (S50) in progression of a song, the following steps will be performed. First, a determination is made for whether or not data to be converted is beginning note data of a phrase (S51). Where the data is determined to be the beginning note data, from each of scale by 12 notes in the chord scale note table, a converted note corresponding to a beginning note is read out (S52: process 1). Next, such scale by 12 notes that an interval between a converted note corresponding to the beginning note and a final note of the previous phrase is made minimum are selected (S53: process 2).

Then, a determination is made for whether or not the scale by 12 notes selected in S53 give a maximum value of the chord scale note table (S54). Where the scale by 12 notes are determined to be a maximum value, such scale by 12 notes that an interval between a converted note corresponding to the beginning note and a reference key number (=71) is made minimum are again selected (S55: process 3), and the process proceeds to S56. Where the scale by 12 notes are not determined to be a maximum value, the process proceeds directly to S56. S55 is provided due to a reason that where the selected scale by 12 notes give a maximum value, that is, where a range higher than an expected range is attained, in order that the range is put back to a reference range so that the range will not be higher any more, selection is made for such scale by 12 notes that an interval between a reference key number and a key number of a converted note corresponding to beginning note data is made minimum from a plurality of scale by 12 notes of the chord scale note table.

In S56, among the thus selected scale by 12 notes, a converted note corresponding to B note is stored in a converted highest note buffer on phrase selection (RAM 102) (S56). This is necessary in order to cope with a change in chord while phrase is played.

Thereafter, the scale by 12 notes selected in S53 or S55 are stored at a chord scale converted note buffer (RAM 102) (S57: process 6), and a phrase note is replaced by a converted note which is a corresponding note in the chord scale converted note buffer (S58: process 7). Thereafter, the replaced phrase note is also stored in a previous note-production phrase final note buffer (RAM 102) (S59), and the process returns. In S59, note data converted by the phrase note conversion process routine is stored each time and used as a next previous note-production phrase final note.

S60 to S62 are flows for coping with a change in chord while phrase is played. More specifically, where note data subjected to phrase conversion is determined in S51 not to be beginning note data of a phrase, a determination is made for whether the change in chord is made or not while phrase is played (S60). Where the change in chord is determined to be made, a converted highest note is read out (S61) from each of the scale by 12 notes in the chord scale note table. Further, selection is made for such scale by 12 notes that an interval between the converted highest note and a converted highest note on phrase selection (stored in S56) is made minimum (S62), and the process proceeds to S57. Where a determination is made in S60 that no change in chord is made while phrase is played, the process proceeds to S58, and the phrase note is replaced by a converted note which is a corresponding a note in the chord scale converted note buffer.

Figure 7:
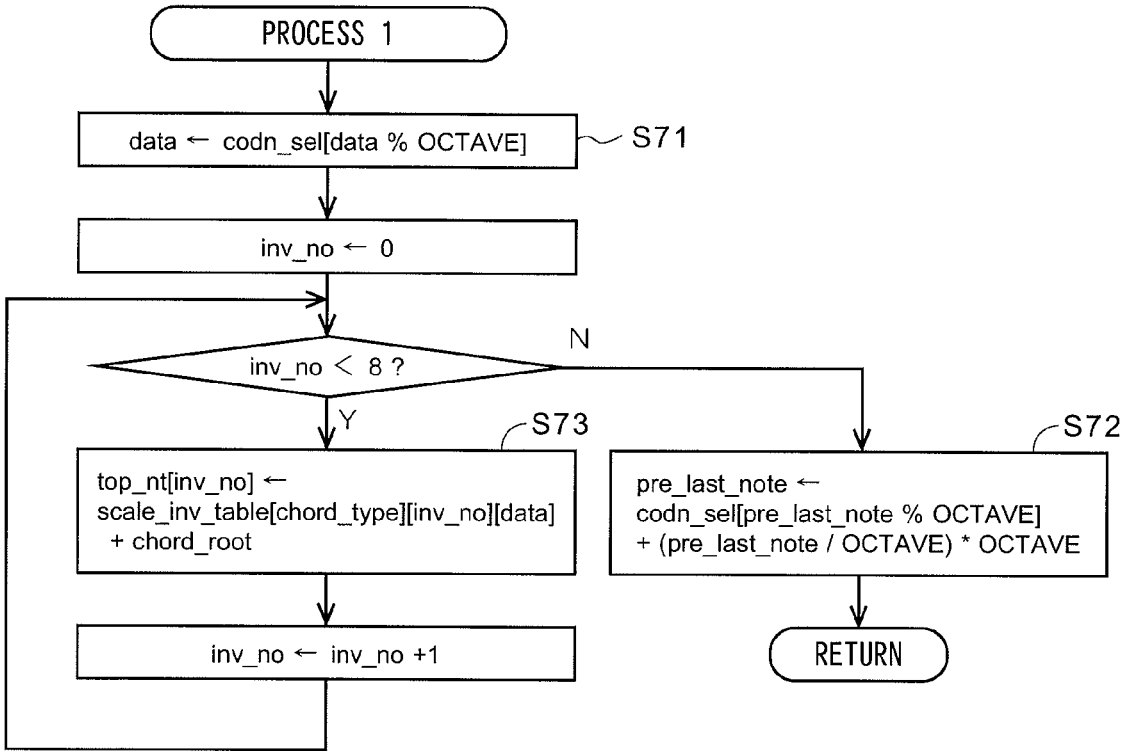
FIG. 7 is a flowchart showing the process 1 (S52) in FIG. 6.

FIG. 7 is a flowchart showing the process 1 (S52) in FIG. 6. Here, as input, data (a note event of phrase (key number)), chord_type, chord_root, pre_last_note (a previous note-production phrase final note) are given. Further, as output, top_nt [8] (a converted note corresponding to a phrase beginning note for each inverted form number), pre_last_note (a previous note-production phrase final note (that in which an ornament is treated as a chord tone) are obtained. In addition, scale_inv_table [6] [8][12], inv_no are respectively a chord scale note table and inverted form numbers of chord scales, which are codn_sel[12]=[0,0,0,4,4,4,7,7,7,11,11,11],OCTAVE=12.

S71 shown in FIG. 7 is a process in which the note event of a phrase (key number) is divided by 12 (the number of half tones contained in one octave) to obtain a remainder and allowed to correspond to scale by 12 notes in the chord scale note table. Further, values which can be obtained are narrowed down to 0, 4, 7, 11. Thereby, where a beginning note of the phrase is an ornament other than a chord tone, it is dealt with as the chord tone. The ornament is mainly an additive note adjacent by half tone or whole tone toward chord tones which are musically important for a phrase, and it is not very significant in terms of a connection before or after a phrase. In a process for selecting such scale by 12 notes that an interval with a final note of the previous note production phrase is made minimum, this ornament note will be musically natural if it is dealt with as a chord tone and this process is, therefore, added.

S72 is a process in which the previously note-produced final note of a phrase is processed similarly as in S71, thereafter, in order to give a key number having octave information, original octave information is added to a value narrowed down by codn_sel[ ].

S73 is a process in which a note event of the phrase obtained in S71 (key number), a current chord type and inverted form numbers of eight chord scaletypes are given as input to obtain from the chord scale note table a key number having octave information for each inverted form number of a chord scale.

Figure 8:
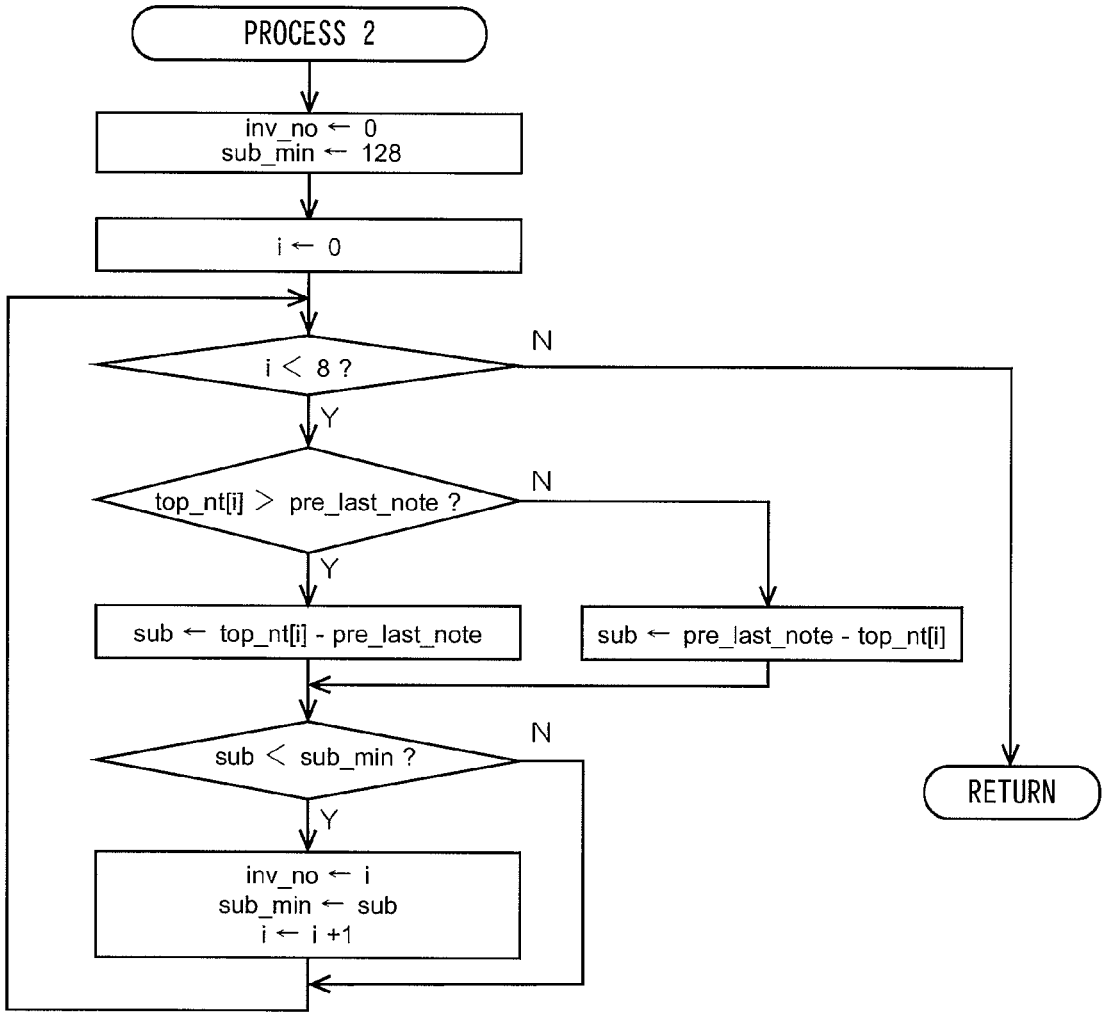
FIG. 8 is a flowchart showing the process 2 (S53) shown in FIG. 6.

FIG. 8 is a flowchart showing the process 2 (S53) shown in FIG. 6. Here, as input, top_nt [8] (a converted note corresponding to a phrase beginning note for each inverted form number) and pre_last_note (a final note of the previous note production phrase) are given, while, as output, inv_no (an inverted form number of scale by 12 notes in which an interval between a converted note of the beginning note and a final note of the previous note production phrase is made minimum) is obtained. In addition, sub_min,sub,inv_no are respectively a minimum value of an interval between a converted note of the beginning note and a final note of the previous note production phrase, an interval (difference) between a converted note of the beginning note and a final note of the previous note production phrase, and an inverted form number of chord scale.

In this process, there is a case where an interval (difference) between a converted note of the beginning note for each inverted form number of chord scale and a final note of the previous note production phrase is the same in value. In this case, a second process is disregarded to select a process in which the scale by 12 notes of chord scale is lower. Thereby, an increase in range each time phrase is selected (depression of keys to which a phrase is assigned) is prevented. This conversely means that each time phrase is selected, a range is decreased. However, the range can be adjusted for deviation by creating phrase data by using a low range to the least possible extent or by creating many upper phrases. In addition, chord scales in the chord scale note table are arrayed so that a range becomes high with an increase in inverted form number.

Figure 9:
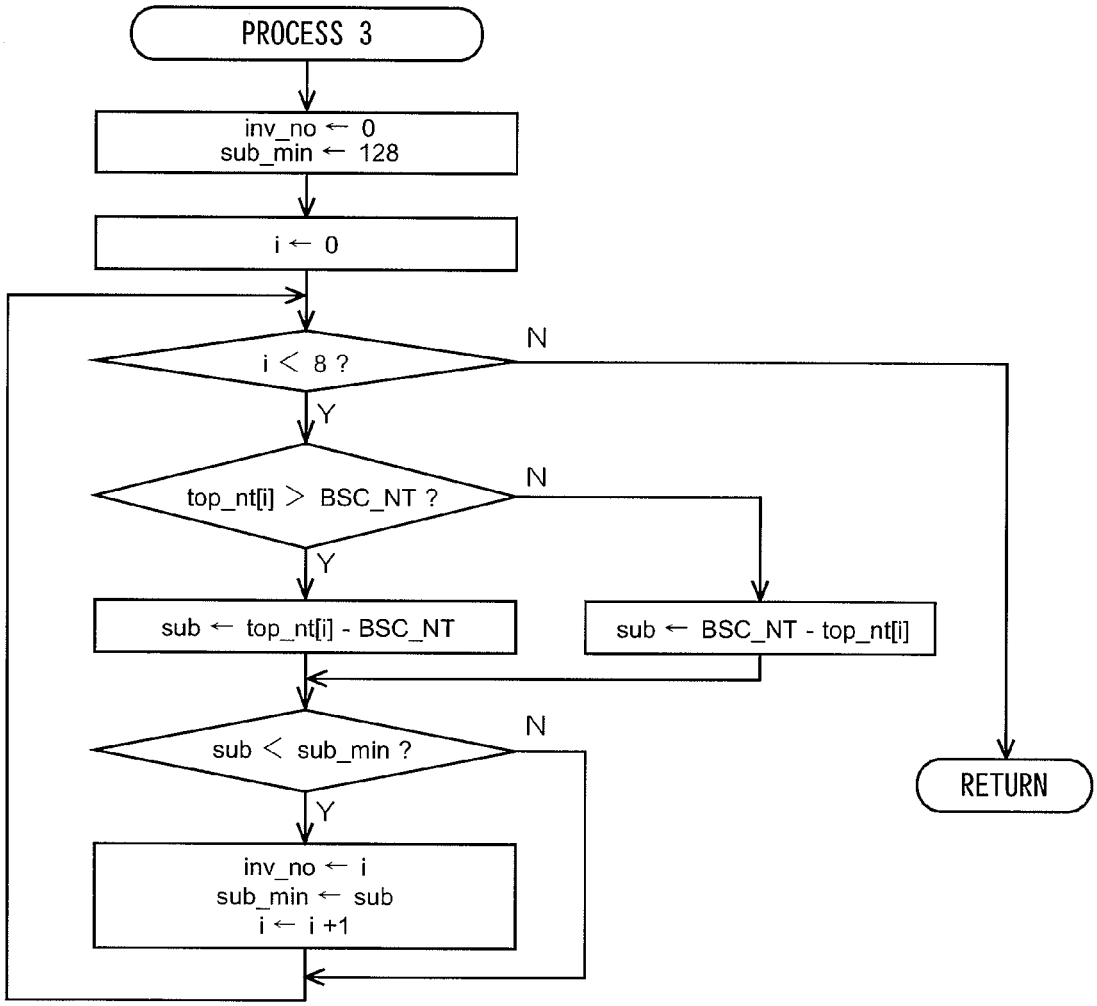
FIG. 9 is a flowchart showing the process 3 (S55) shown in FIG. 6.

FIG. 9 is a flowchart showing the process 3 (S55) shown in FIG. 6. Here, as input, top_nt [8] (a converted note corresponding to a phrase beginning note for each inverted form number) is given, while, as output, inv_no (an inverted form number of scale by 12 notes in which an interval between a converted note of the beginning note and a reference key number is made minimum) is obtained. In addition, sub_min, sub,inv_no,BSC_NT are respectively a minimum value of an interval between a converted note of the beginning note and a reference key number, an interval (difference) between a converted note of the beginning note and a reference key number, an inverted form number of chord scale, and a reference key number.

Since the flowchart shown in FIG. 9 is the same in structure as that shown in FIG. 8 except that variables are different, the description will be omitted here. Thereby, an inverted form number of scale by 12 notes in which an interval between a converted note of the beginning note of phrase and a reference key number is made minimum is obtained.

Figure 10:
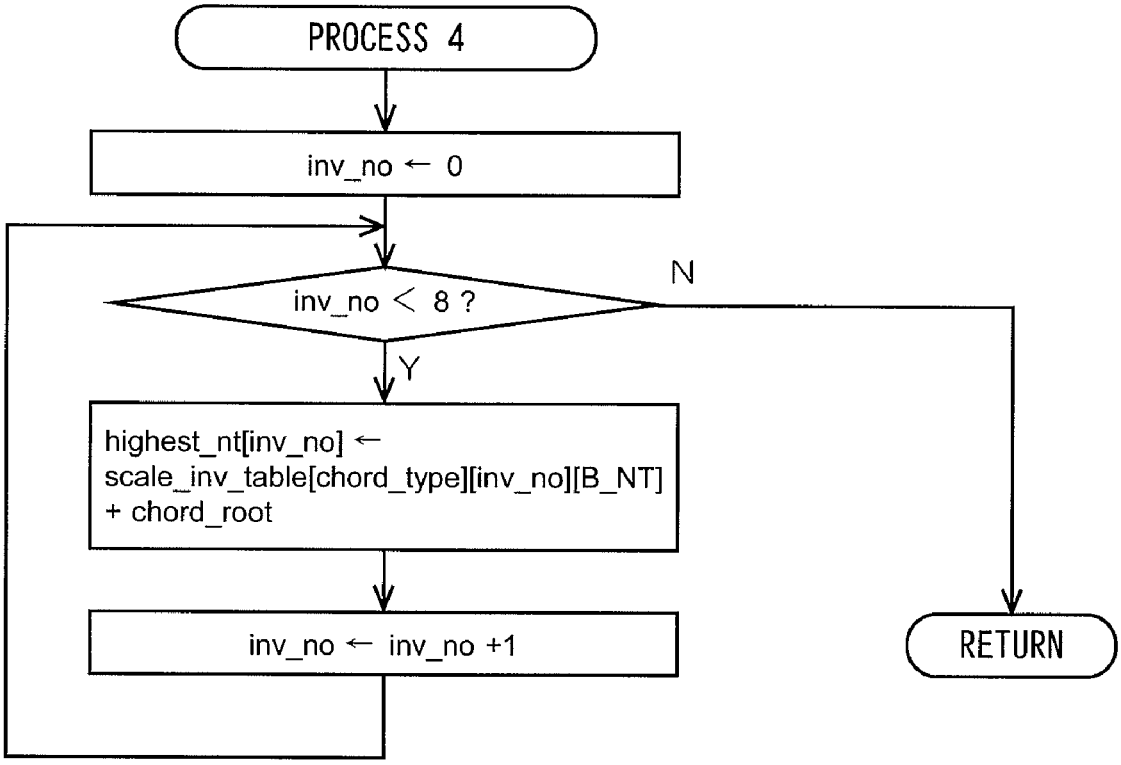
FIG. 10 is a flowchart showing the process 4 (S61) shown in FIG. 6.

FIG. 10 is a flowchart showing the process 4 (S61) shown in FIG. 6. Here, as input, chord_type and chord_root are given, while, as output, highest_nt[8] (a converted highest note for each inverted form number of chord scale) is obtained. In addition, scale_inv_table[6][8][12], inv_no are respectively a chord scale note table and an inverted form number of chord scale, which is B_NT=11.

Since the flowchart shown in FIG. 10 is the same in structure as that shown in FIG. 7 except that variables are different, the description will be omitted here. Thereby, a converted highest note is read out from each scale by 12 notes in the chord scale note table.

Figure 11:
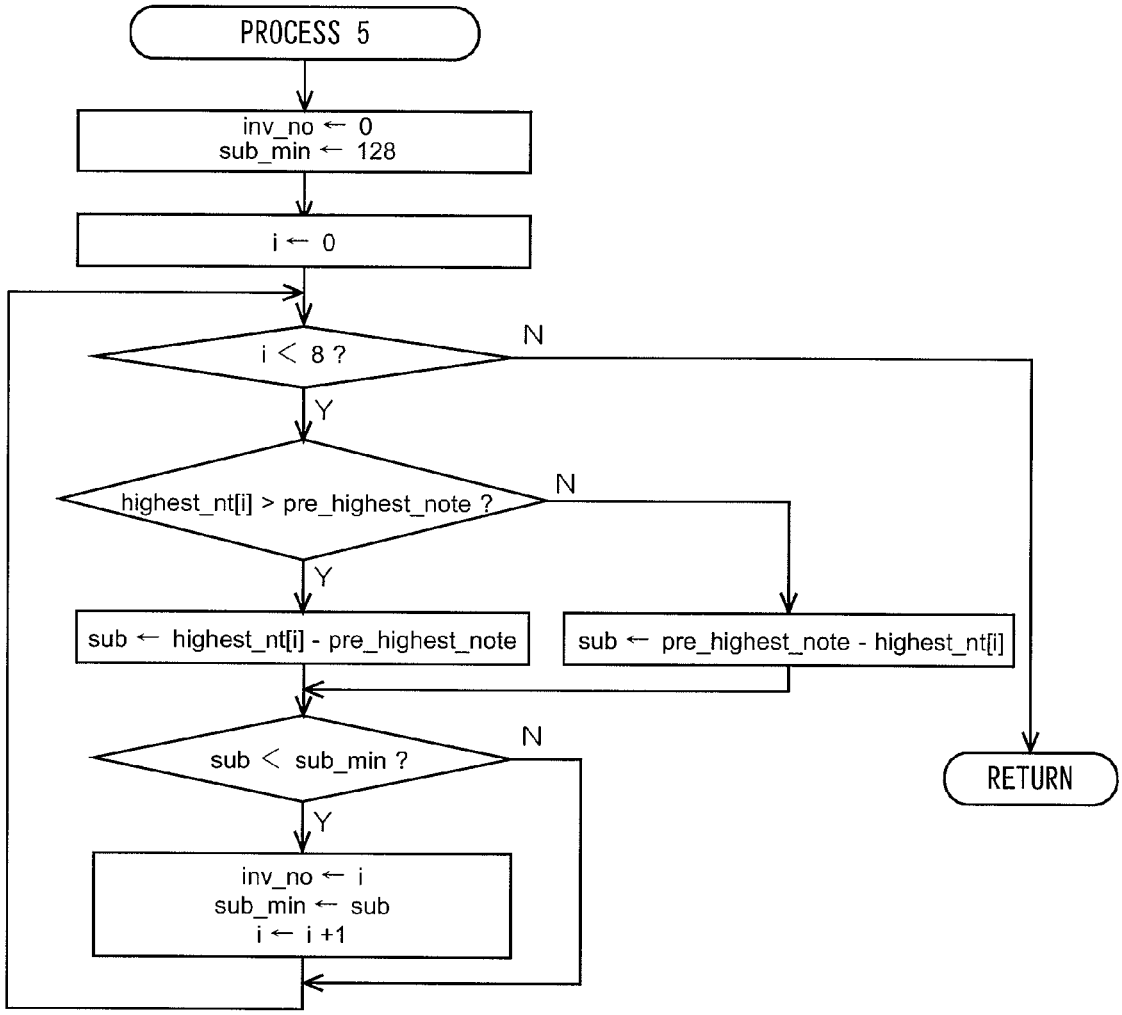
FIG. 11 is a flowchart showing the process 5 (S62) shown in FIG. 6.

FIG. 11 is a flowchart showing the process 5 (S62) shown in FIG. 6. Here, as input, highest_nt[8] (a converted highest note for each inverted form number of chord scale) and pre_highest_note (a converted highest note on phrase selection) are given, while, as output, inv_no (an inverted form number of scale by 12 notes in which an interval between a converted highest note of each chord scale and a converted highest note on phrase selection is made minimum) is obtained. In addition, sub_min,sub,inv_no are respectively a minimum value of an interval between a converted highest note of chord scale and a converted highest note on phrase selection, an interval (difference) between a converted highest note of each chord scale and a converted highest note on phrase selection, and an inverted form number of chord scale.

The flowchart shown in FIG. 11 is the same in structure as that shown in FIG. 8 except that variables are different. In this process, there is a case where an interval (difference) between a converted highest note of each chord scale and a converted highest note on phrase selection is the same in value. In this case, a second process is disregarded to select a process in which the scale by 12 notes of chord scale is lower. This means that a selected phrase now in note production is continuously subjected to note production on a decline by a change in chord, thereby making the phrase better-suited.

A converted highest note for each inverted form number of chord scale corresponding to a change in chord by the process 4 is compared with a converted highest note on phrase selection which is selected when a beginning note of a phrase currently in note production is converted, and a new chord scale in which an interval (difference) between these notes is made minimum is used as a converted note of the phrase. Thereby, even where change in chord is found, it is possible to continuously produce notes from the time when the phrase is selected substantially at the same range. In addition, here, the highest notes (12th note) in these two chord scales are to be compared but comparison may be made for any note arranged as chord tones, for example, any one of first, fifth and eighth notes.

Figure 12:
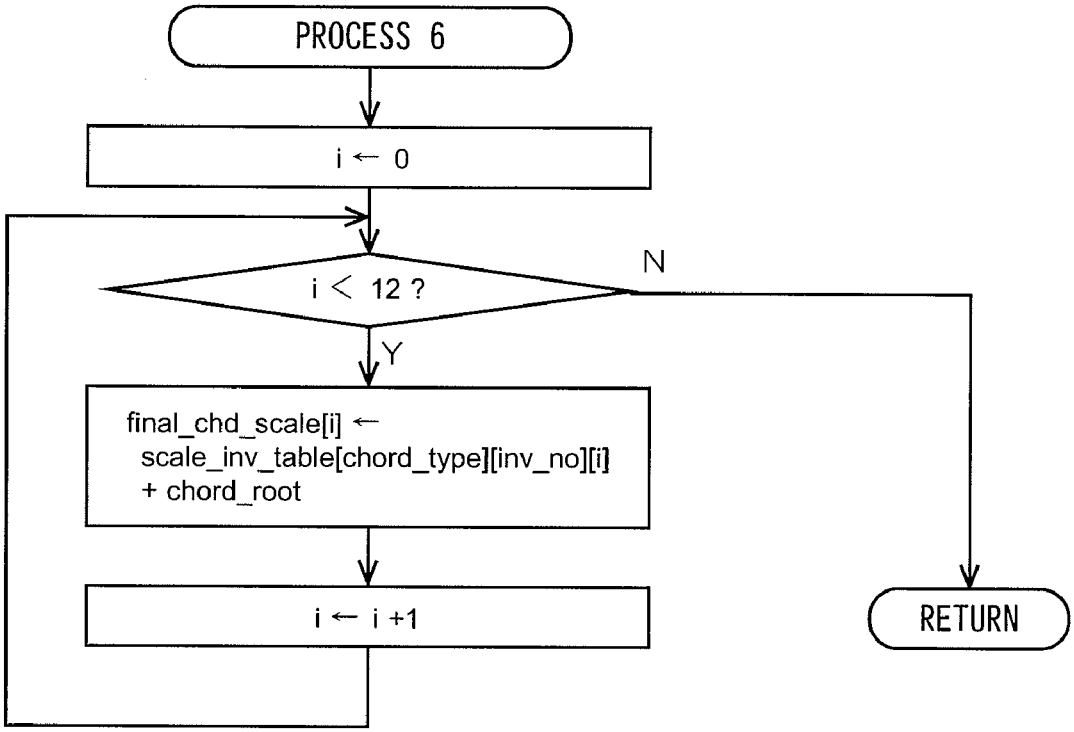
FIG. 12 is a flowchart showing the process 6 (S57) shown in FIG. 6.

FIG. 12 is a flowchart showing the process 6 (S57) shown in FIG. 6. Here, as input, chord_type, chord_root and inv_no (an inverted form number of scale by 12 notes in which an interval between a converted note of the beginning note and a final note of the previous note production phrase is made minimum, or an inverted form number of scale by 12 notes in which an interval between a converted note of the beginning note and a reference key number is made minimum, or an inverted form number of scale by 12 notes in which an interval between a converted highest note of each chord scale and a converted highest note on phrase selection is made minimum) are given, while, as output, final_chd_scale [12] (a converted note of chord scale) is obtained. The final_chd_scale[12] is stored as a converted note of chord scale in scale by 12 notes in a chord scale converted note buffer. In addition, scale_inv_table[6][8][12],inv_no are respectively a chord scale note table and an inverted form number of chord scale.

Figure 13:
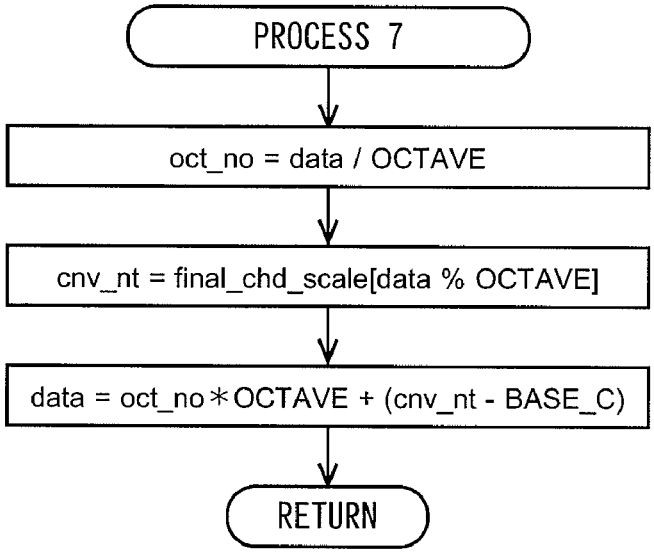
FIG. 13 is a flowchart showing the process 7 (S58) shown in FIG. 6.

FIG. 13 is a flowchart showing the process 7 (S58) shown in FIG. 6. Here, as input, data (a note event of phrase (key number)) is given, while, as output, data (a converted note event (key number)) is obtained. A phrase note is replaced by this data. In addition, oct_no,cnv_nt,final_chd_scale[12] are respectively octave information, a converted note of phrase note, and a converted note of chord scale, which are OCTAVE=12, BASE_C=60.

The phrase note converted note is a note of scale by 12 notes selected by a chord scale note table, and the chord scale note table is prepared by referring to a central C4 (key number 60) and has octave information. In the flowchart shown in FIG. 13, in order to eliminate the reference octave information, the key number 60 is deducted from the phrase note converted note. On the other hand, the octave information contained in the note event of phrase is to show a hierarchical relationship of individual note events where the phrase is compared over two octaves or more and needed in the converted phrase for keeping the hierarchical relationship.

Figure 14:
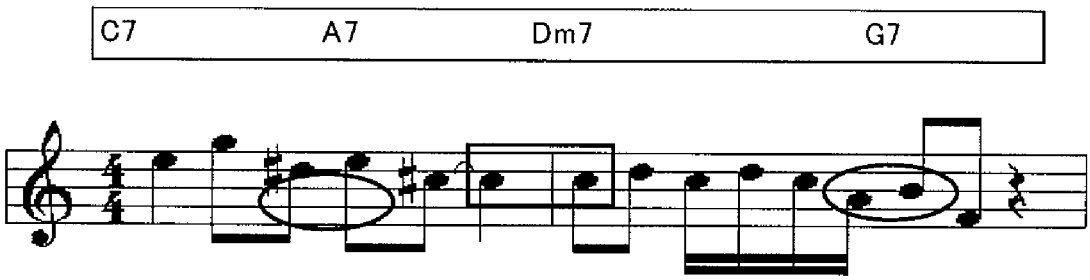
FIG. 14 is a drawing showing a musical note in which the phrase shown in FIG. 19 is subjected to the conversion of phrase note by using the chord scale note table in FIG. 5.

FIG. 14 is a drawing showing a musical note in which the phrase shown in FIG. 19 is subjected to the conversion of phrase note by using the chord scale note table in FIG. 5. In order to make an easy comparison with FIG. 20, here, as with FIG. 20, a case where phrase 1, 2 are changed in chord at every two beats to give C7, A7, Dm7, G7 is shown. In the following description, reference will be made to FIG. 5 to FIG. 13, whenever necessary.

First, consideration is given to a time point at which Ti (key number 71) of a first note (beginning note) in phrase 1 is input into a phrase conversion process routine. In S50 (FIG. 6), reference is made to a chord root and a code type at this time point. The chord root is set to be, for example, C=0, C♯=1, D=2, D♯=3, E=4, F=5, F♯=6, G=7, G♯=8, A=9, A♯=10, B=11. In this instance, the chord root refers to C (chord_root=0), and the chord type refers to 7th (chord_type=3).

Since Ti, which is a first note, is beginning note data, the process 1 (S52) is performed to give data=11, chord_type=3, chord_root=0, and from each of the scale by 12 notes in the chord scale note table, a converted note corresponding to a beginning note is read out. In this instance, as top_nt [8], E__4 (key number 64), G__4 (67), B♭4 (70), C__5 (72), E__5 (76), G__5 (79), B♭5 (82), C__6 (84) is obtained. Further, since there is no final note of the previous note production phrase, the key number 76 (E__5) which is temporarily given as an initial value is obtained as pre_last_note.

Next, in the process 2 (S53), such scale by 12 notes that an interval between a converted note of the beginning note and a final note of the previous note production phrase is made minimum is selected. In the process 2, finally inv_no=4, sub_min=0 are obtained.

Next, in S54, the process is determined to be NO and proceeds to S56. In S56, among the selected scale by 12 notes, a converted note corresponding to B note is stored in a converted highest note buffer on phrase selection. In this instance, 76 (E__5) (=scale_inv_table[3(chord_type)][4(inv_no)][11]+0(chord_root))) is stored in the converted highest note buffer on phrase selection, pre_highest_note.

Next, in the process 6 (S57), the above scale by 12 notes are stored in a chord scale converted note buffer. In this instance, as final_chd_scale[12], G__4 (key number 67), G♭4 (66), G__4 (67), A__4 (69), B♭4 (70), B♭4 (70), B__4 (71), C__5 (72), C__5 (72), E__5 (76), E♭5 (75), E__5 (76) are obtained.

Next, in the process 7 (S58), the phrase note is replaced by a converted note is a corresponding note in which the chord scale converted note buffer. Thereby, data=76(E__5) is obtained, and Ti (key number 71) of the beginning note is finally converted to Mi (key number 76). In this instance, the beginning note is chained in homophony with a final-note key number 76 (E__5) of the previous note production phrase which is set as an initial value.

Then, consideration is given to a time point at which Ti (key number 71) of a fourth note in phrase 1 is input into a phrase conversion process routine. In S50, reference is made to a chord root and a chord type at this time point. At this time point, since a chord is changed from C7 to A7, the chord root refers to A (chord_root=9) and the chord type refers to 7th (chord_type=3).

Since Ti, which is a fourth note, is not beginning note data but a chord is changed during chord note production, the process 4 (S61) and the process 5 (S62) are performed. In the process 4, from each of the scale by 12 notes in the chord scale note table, a converted highest note, that is, a highest note B in scale by 12 notes of C to B in the chord scale note table is read out. By the process 4, as highest_nt[8], C♯5 (key number 73), E__5 (76), G__5 (79), A__5 (81), C♯6(85), E__6 (88), G__6 (91), A__6) 93) are obtained. In the process 5, such scale by 12 notes that an interval between the above converted highest note and a converted highest note on phrase selection is made minimum are selected. Thereby, finally, inv_no=1, sub_min=0 are obtained.

Next, in the process 6 (S57), the selected scale by 12 notes are stored in a chord scale converted-note buffer. In this instance, as final_chd_scale[12], G__4 (key number 67), F♯4 (66), G__4 (67), G♯4 (68), A__4 (69), C♯5 (73), C__5 (72), C♯5 (73), D♯5 (75), E__5(76), D♯5 (75), E__5 (76) are obtained.

Then, in the process 7 (S58), the phrase note is replaced by a converted note which is a corresponding note in the chord scale converted note buffer. Thereby, data=76 (E__5) is obtained, and Ti (key number 71) of a fourth note is finally converted to Mi (key number 76).

When a chord scale converted note final_chrd_scale[12] at the time of chord C7 of the above chord is compared at any column with that at the time of chord A7, an interval between them is within three half tones. This means that even when phrase 1 which starts note production at chord C7 is changed to chord A7 at any timing, an original phrase will not undergo a great change in shape. More specifically, it means that there is no great note jump when the chord is changed while phrase is played.

As a result of the conversion of phrase, a third note and a fourth note in phrase 1 are smoothly chained by half tone to give E♭5 (=d♯5, key number 75) at the time of C7 chord and E__5 (key number 76) at the time of A7 chord, and a sixth note and a seventh note in phrase 2 are smoothly chained by whole tone (2 half tone) (a part enclosed with the round frame). This is realized by procedures in which a chord scale note table composed of a plurality of scale by 12 notes starting from a chord tone in which C note is given as a root note and arranging a chord scale note as an inverted form of a chord in which the note is given as the lowest note is used, a chord scale note is selected from the chord scale note table so as to make notes before or after a change in chord as close as possible, and the chord scale note is used to convert the phrase.

Ti (key number 71) of a first note (beginning note) in phrase 2 is similarly converted to "Do" and smoothly chained to a final note, "Do♯" in phrase 1 (a part enclosed with the square frame). This is also realized by procedures in which a chord scale note table composed of a plurality of scale by 12 notes starting from a chord tone in which C note is given as a root note and arranging a chord scale note as an inverted form of a chord in which the note is given as the lowest note is used, even where a final note of phrase which has been subjected to the previous note production is at any pitch, a chord scale note is selected from the chord scale note table so as to make a beginning note of phrase subjected to the current note production as close as possible to the note, and the chord scale note is used to convert the phrase.

As described above, when each of keys in a specific range on a keyboard to which phrase data of a few bars is assigned is depressed to perform ad-lib performance, an interval at the beginning of the current phrase is chained to an interval at the end of the previous phrase, by which it is possible to prevent a great note jump between the phrases. Further, even if any change in chord while phrase is played is found, it is possible to suppress note jump resulting from the change thereof.

Next, a description will be given for a second embodiment of the present invention. In the second embodiment, where time from the previous key-off to the current key-on is in excess of a predetermined time, no note jump is suppressed between the phrases, thus making it possible to produce musical sounds closer to live performance. In the following, a description will be given only for points of the second embodiment which are different from those of the first embodiment.

Figure 15:
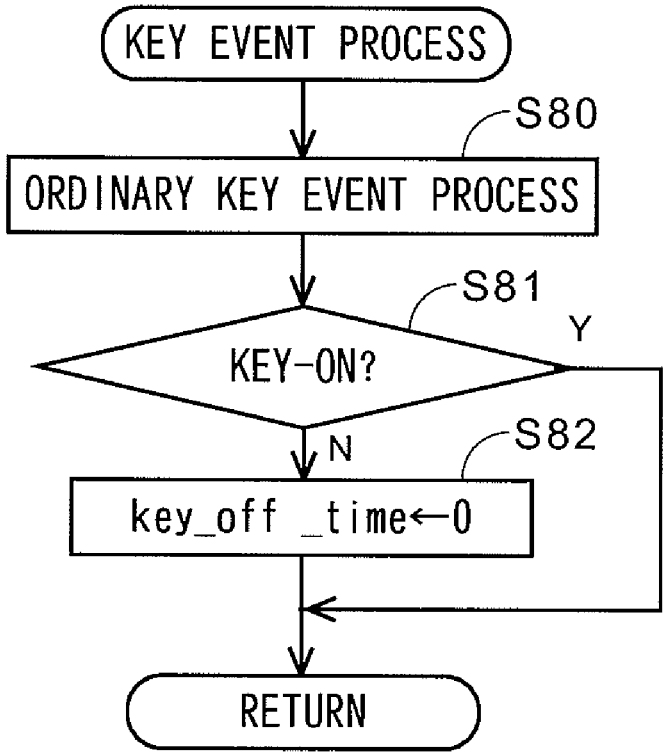
FIG. 15 is a flowchart showing a key event process in the second embodiment.

FIG. 15 is a flowchart showing a key event process in the second embodiment. This is a process within S12 shown in FIG. 4.

In the key event process, first, an ordinary key event process by a key event is performed (S80). This ordinary key event process corresponds to a key event process in the first embodiment.

Then, a determination is made for whether or not the key event is key-on (S81). In S81, where the event is determined to be key-on, the process returns, as it is, and proceeds to S13 (FIG. 4). However, where the event is determined not to be key-on, that is, key-off, a timer for measuring key-off time is reset (key_off_time<-0) (S82). This timer is to increment key_off_time at the usual time and reset at the time of key-off. Therefore, the key_off_time indicates time elapsed from the time of key-off.

Figure 16:
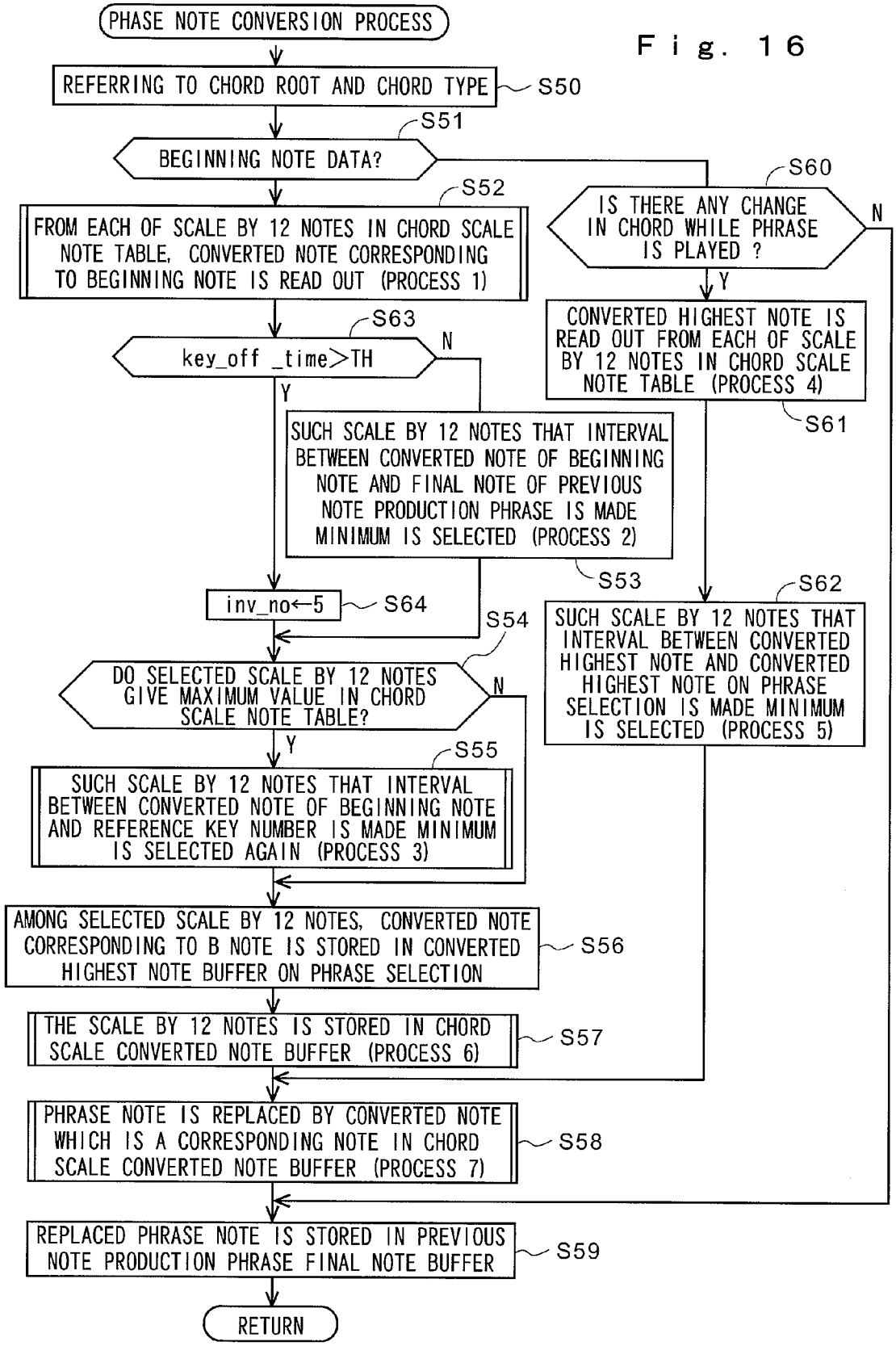
FIG. 16 is a flowchart showing a phrase note conversion process routine in the second embodiment.

FIG. 16 is a flowchart showing a phrase note conversion process routine in the second embodiment. This flowchart is different from the flowchart shown in FIG. 6 in that a determination is made for whether or not key_off_time is in excess of a predetermined time TH which is set in advance after S52 (S63), where the key_off_time is determined not to be in excess of the predetermined time TH which is set in advance, as with the first embodiment, S53 (the process 2) is performed and thereafter the process proceeds to S54, but where the key_off_time is determined to be in excess, S53 is not performed and the phrase data is set to be in a predetermined range (S64), and the process proceeds to S54.

The predetermined time TH is preferably set in the unit of a bar or a beat in view of smooth performance. For example, the predetermined time TH is set so as to cover two bars.

In S64, an inverted form number is set to be 5 (inv_no<-5). This is because phrase data is to give a predetermined range. In addition, the chord type is that which is referred to in S50. Thereby, where time from key-off to key-on for ad-lib performance is in excess of the predetermined time TH, the phrase data thereof is converted into a range which is inverted form number 5 in the chord scale note table. In S64, other inverted form numbers other than 5 may be set. The predetermined time TH or the inverted form number is set in advance as a default on shipment from a plant or the like.

A description has been given so far for the embodiments to which the present invention shall not be limited. For example, plural sets of phrase data segmented for each song of automatic performance (group), each tone (group) and each tempo are stored, and one set of phrase data may be selected from them, whenever necessary.

FIG. 17 is a drawing showing examples of plural sets of phrase data. In these examples, phrase data is segmented according to each song of automatic performance (group), each tone (group) and for moderate/low tempo or high tempo. Songs of automatic performance are grouped according to styles of songs (music genre) into jazz, Latin music and blues, for example. Tone is grouped into those of the piano and the organ, for example. Further, tempo is grouped into moderate/low and high. Moderate/low tempo or high tempo is determined, for example, by whether or not the tempo is 180 (BPM: beat per minute) or lower.

Phrase data of a specific set is read out from the RAM 101 by operating operation buttons on the panel 105. More specifically, according to selection of songs by a song selecting button, selection of tone by a tone selecting button and selection of tempo by a tempo selecting button, one set of phrase data is read out.

If, in the examples shown in FIG. 17, operation buttons on the panel 105 are operated to select, for example, a song (group) 1, a tone (group) 2 and a tempo which is 180 or lower (moderate/low), phrase data (1'), (2'), (3'), . . . are assigned respectively to each of keys (key (1), key (2), key (3), . . . ) for ad-lib performance. Further, if the song (group)1, a tone (group)1 and a tempo in excess of 180 (high) are selected, phrase data (1"), (2"), (3"), . . . are assigned respectively to each of keys for ad-lib performance (key (1), key (2), key (3), . . . ).

As described above, the phrase data is segmented, by which it is possible to ad-lib perform with phrases in agreement with a style of songs by automatic performance (music genre), tone, and tempo. For example, where a tone is changed to that of the piano, it is possible to ad-lib perform with phrases in agreement with tuned notes, and where a tone is changed to that of the organ, it is possible to ad-lib perform phrases in agreement with continuous notes. Further, for example, where a tempo is slow, it is possible to ad-lib perform slow phrases smaller in the number of notes, and where a tempo is high, it is possible to ad-lib perform articulated phrases greater in the number of notes.

What is claimed is:

1. An electronic musical instrument having ad-lib performance function, in which a phrase of a few bars assigned to each of a plurality of keys in a specific range on a keyboard is stored and a phrase is assigned to a key is read out to produce notes when the key is depressed, comprising:

a chord scale note table comprised of a plurality of scale by 12 note scales starting from a C note as a root and arranging chord scale notes as a chord inverted form in which the note is a lowest note; and a control unit for changing notes in the phrase assigned to the depressed key by using the chord scale note table to suppress a note jump.

2. The electronic musical instrument according to claim 1, wherein in a case of a beginning note in the phrase, the control unit is configured to select a scale in which an interval between a key number of a final note in a previous phrase and a key number of a converted note corresponding to the beginning note is made minimum from the chord scale note table corresponding to a chord, and to replace the beginning note with a corresponding converted note among the notes in the selected scale.

3. The electronic musical instrument according to claim 2, wherein where the selected scale provides a maximum value and reaches a higher range than an expected range, the control unit is further configured to select a scale in which an interval between a reference key number and a key number of a converted note corresponding to the beginning note is made minimum from the chord scale note table corresponding to the chord and replaces the beginning note with a corresponding converted note among the notes in the selected scale.

4. The electronic musical instrument according to claim 1, wherein the notes in the scale are obtained by selecting where there is any change in chord during note production of a phrase and in the case of a beginning note in the phrase, a scale in which an interval between a key number of a final note in a previous phrase and a key number of a converted note corresponding to the beginning note is made minimum from the chord scale note table corresponding to the chord where the selected scale provides a maximum value and reaches a higher range than an expected range, a scale in which an interval between a reference key number and a key number of a converted note corresponding to the beginning note is made minimum from the chord scale note table corresponding to the chord, wherein the control unit is further configured to select a scale in which an interval between a key number of a converted note of a predetermined note arranged as the note and a key number of a converted note corresponding to the predetermined note is made minimum from the chord scale note table corresponding to a changed chord, and replaces the note after a change in chord with a corresponding converted note among the notes in the selected scale.

5. The electronic musical instrument according to claim 1, wherein where time from the previous key-off to the current key-on is in excess of a predetermined time, the control unit does not suppress note jump between a final note in a the previous phrase and a beginning note in a current phrase, and allows the current phrase to produce notes in a predetermined range.

6. A non-transient computer-readable medium for ad-lib performance function, in which a phrase of a few bars assigned to each of keys in a specific range on a keyboard is stored and a phrase assigned to the key is read out to produce notes while each of keys is depressed, the computer-readable medium having instructions therein, the instructions when executed by a processor cause the processor to perform:

changing notes in the phrase assigned to the depressed key by using a chord scale note table;

changing notes, wherein the cord scale note table is comprised of a plurality of 12 notes scale starting from a C note as a root; and arranging chord scale notes as a chord inverted form in which the note is the lowest note to realize the ad-lib performance function, and suppress a note jump.

7. The non-transient computer-readable medium according to claim 6, further comprising:

selecting a scale in which interval between a key number of a final note in the previous phase and a key number of a converted note corresponding to the beginning note is made minimum from the cord scale note table corresponding to a chord in a case of a beginning note in a phase; and replacing the beginning note with corresponding converted note among the notes in the selected scale.

8. The non-transient computer-readable medium according to claim 7, wherein, where the selected scale gives a maximum value and reaches a higher range than an expected range, the first step further selects again such scale that an interval between a reference key number and a key number of a converted note corresponding to the beginning note is made minimum from the chord scale note table corresponding to a chord at the time, and the second step replaces the beginning note is replaced with a corresponding converted note among notes in the selected scale.

9. The non-transient computer-readable medium according to claim 6, wherein the notes of scale are obtained by selecting where there is any change in chord during note production of a phrase and in the case of a beginning note in the phrase, a scale in which that an interval between a key number of a final note in a previous phrase and a key number of a converted note corresponding to the beginning note is made minimum from the chord scale note table corresponding to the chord, where the selected scale provides a maximum value and reaches a higher range than an expected range, a scale in which an interval between a reference key number and a key number of a converted note corresponding to the beginning note is made minimum from the chord scale note table corresponding to a chord, and selecting a scale in which an interval between a key number of a converted note of a predetermined note arranged as the note and a key number of a converted note corresponding to the predetermined note is made minimum from the chord scale note table corresponding to a changed chord, and replacing the note after a change in chord with a corresponding converted note among the notes in the selected scale.

10. The non-transient computer-readable medium according to claim 6, wherein where time from a previous key-off to a current key-on is in excess of a predetermined time, the note jump is not suppressed between a final note in the previous phrase and a beginning note in the current phrase and the current phrase is allowed to produce notes in a predetermined range.

* * * * *